US008218797B2

(12) United States Patent
Lee et al.

(10) Patent No.: US 8,218,797 B2
(45) Date of Patent: Jul. 10, 2012

(54) MICRO-SPEAKER AND MANUFACTURING METHOD THEREOF

(75) Inventors: Hsin-Li Lee, Hsinchu County (TW); Chin-Horng Wang, Hsinchu (TW); Cheng-Hsin Chuang, Tainan (TW); Jin-Yao Lai, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 517 days.

(21) Appl. No.: 12/431,736

(22) Filed: Apr. 28, 2009

(65) Prior Publication Data

US 2010/0150381 A1 Jun. 17, 2010

(30) Foreign Application Priority Data

Dec. 17, 2008 (TW) ..... 97149292 A

(51) Int. Cl.
*H04R 25/00* (2006.01)

(52) U.S. Cl. ..... 381/190

(58) Field of Classification Search ..... 381/190
See application file for complete search history.

(56) References Cited

U.S. PATENT DOCUMENTS 4,439,640 A 3/1984 Takaya
5,365,937 A * 11/1994 Reeves et al. ..... 600/528
5,805,726 A 9/1998 Yang et al.
6,612,399 B1 * 9/2003 Corsaro ..... 181/171
7,166,952 B2 1/2007 Topliss et al.
7,170,822 B2 1/2007 Peck
2002/0176592 A1 * 11/2002 Howarth et al. ..... 381/190
2008/0130921 A1 * 6/2008 Tokuhisa et al. ..... 381/190

FOREIGN PATENT DOCUMENTS

CN 1130458 A 9/1996

OTHER PUBLICATIONS

"First Office Action of China Counterpart Application", issued on Sep. 21, 2011, p. 1-p. 4.

* cited by examiner

*Primary Examiner* — Charles Garber
*Assistant Examiner* — Andre' C Stevenson
(74) *Attorney, Agent, or Firm* — Jianq Chyun IP Office

(57) ABSTRACT

A micro-speaker and a manufacturing method thereof are provided. The micro-speaker has a sandwich structure. The micro-speaker includes two piezoelectric material layers and a diaphragm disposed between the two piezoelectric material layers, where the piezoelectric material layers have a ring-shaped structure. The problem of insufficient sound pressure at low frequency is resolved, and the flexibility of the micro-speaker is improved.

17 Claims, 8 Drawing Sheets

MICRO-SPEAKER AND MANUFACTURING METHOD THEREOF

CROSS-REFERENCE TO RELATED APPLICATION

This application claims the priority benefit of Taiwan application serial no. 97149292, filed on Dec. 17, 2008. The entirety of the above-mentioned patent application is hereby incorporated by reference herein and made a part of specification.

BACKGROUND OF THE INVENTION

1. Field of the Invention

The present invention generally relates to a speaker, and more particularly, to a micro-speaker and a manufacturing method thereof.

2. Description of Related Art

A speaker produces sound by generating electrical signals and stimulating a diaphragm with the electrical signals. Speakers can be applied to various electronic products, such as cell phones, notebook computers, personal digital assistants (PDAs), digital cameras, and flat-panel TVs. Presently, the designs of different electronic products are all going towards lightness, slimness, shortness, and smallness, and high versatility. Accordingly, speakers should also be developed and manufactured through more advanced techniques in order to increase the market competitiveness thereof.

Speakers can be categorized into moving-coil speakers, piezoelectric speakers, and electrostatic speakers according to the operation principles thereof. The moving-coil speaker is currently the most broadly used and mature speaker. However, it is difficult to reduce the size of a moving-coil speaker due to the structure thereof.

According to the operation principle of the conventional electrostatic speaker, a conductive diaphragm is held between two fixed electrodes to form a capacitor. By supplying a direct current (DC) bias to the diaphragm and an alternating current (AC) voltage to the two fixed electrodes, an electrostatic force is produced by the electric fields, and the conductive diaphragm is vibrated by the electrostatic force to produce sound. However, the bias supplied to the conventional electrostatic speaker should be up to hundreds or even thousands voltages. Accordingly, an amplifier of high cost and bulky size has to be connected externally. As a result, the conventional electrostatic speaker cannot be broadly applied to different electronic products.

A piezoelectric speaker adopts the piezoelectric effect of a piezoelectric material. When an electric field is supplied to the piezoelectric material, deformation of the piezoelectric material will drive the diaphragm to produce sound. However, even though the piezoelectric speaker has a small and slim size, it is still not flexible because the piezoelectric material needs to be sintered.

A laminated piezoelectric transducer and a method for manufacturing the same are disclosed in U.S. Pat. No. 7,170,822. FIGS. 1(*a*)~1(*c*) are diagrams illustrating the structure and laminated package of a conventional laminated piezoelectric transducer 100. Referring to FIG. 1(*a*), an upper and a lower layer of the laminated piezoelectric transducer 100 are two metal discs 102, and the thickness of each of the metal discs 102 is 0.005 inches. A middle layer of the laminated piezoelectric transducer 100 is a piezoelectric disc 104. Foregoing three layers form a disc structure 101 such that the amplitude can be increased. Referring to FIG. 1(*b*), an upper gasket 106 and a lower gasket 106 of the laminated piezoelectric transducer 100 are packaged together with the disc structure 101 to form a laminated piezoelectric transducer package 105. Then, a rubber gasket 108 is disposed to form a chamber, as shown in FIG. 1(*c*). According to the present disclosure, the chamber is formed in the laminated piezoelectric transducer for increasing both sound pressure and sound quality and allowing the laminated piezoelectric transducer to be applied underwater. However, because only a single-sided piezoelectric ceramic is used for driving the diaphragm, insufficient sound pressure may be caused. Besides, the laminated piezoelectric transducer in the present disclosure has very limited applications due to its low flexibility.

A piezoelectric full-range loudspeaker is disclosed in U.S. Pat. No. 5,805,726. FIG. 2(*a*) is a cross-sectional view of a piezoelectric full-range loudspeaker 200, and FIG. 2(*b*) is a top view of the piezoelectric full-range loudspeaker 200. Referring to FIG. 2(*a*) and FIG. 2(*b*), the speaker is composed of two metal alloy sheets 202 and a damping sheet 204 held between the two metal alloy sheets 202, and a sound production unit composed of a piezoelectric sheet 206 is disposed outside of the metal alloy sheets 202. Bonding wires 208 are respectively disposed outwards on the metal alloy sheets 202 and the piezoelectric sheet 206. Thus, sound can be produced when currents pass through the bonding wires. According to the present disclosure, a better sound quality is obtained by adopting the damping sheet, and the speaker in the present disclosure has such advantages as small volume, high definition sound quality, low power consumption, and no electromagnetic wave interference. Accordingly, the speaker in the present disclosure can be applied to small-sized portable electronic sound production products. However, the speaker in the present disclosure requires a very complicated manufacturing process and very high cost. Besides, because a single-sided piezoelectric sheet is adopted for driving a diaphragm having a composite structure, there may be insufficient sound pressure. Additionally, the speaker in the present disclosure has very low flexibility. Accordingly, the speaker in the present disclosure has limited applications.

A piezoelectric speaker is disclosed in U.S. Pat. No. 4,439,640. FIG. 3(*a*) illustrates a piezoelectric speaker 300. Referring to FIG. 3(*a*), a piezoelectric ceramic disc 302 and a metal disc 304 are served as the vibration source. A diaphragm 306 is disposed on the piezoelectric ceramic disc 302 and the metal disc 304. A chamber 310 is formed in the middle by using two brackets 308. Accordingly, an acoustic system is formed. FIG. 3(*b*) illustrates an upgraded piezoelectric speaker 300A, wherein a disc diaphragm 312 and a bracket 308 are further disposed on top. FIG. 3(*c*) illustrates the frequency response curves of the piezoelectric speaker 300 and the upgraded piezoelectric speaker 300A. The curves C1 and C2 respectively represent the performances of the piezoelectric speaker 300 and the upgraded piezoelectric speaker 300A.

The upgraded piezoelectric speaker 300A is more stable and has better low-frequency performance than the piezoelectric speaker 300. According to the present disclosure, a piezoelectric ceramic is used as the vibration source such that the diaphragm has higher amplitude compared to general piezoelectric materials. Besides, the speaker in the present disclosure can be applied to non-flexible electronic products. However, since a single-sided piezoelectric ceramic sheet is adopted in the present disclosure for driving a diaphragm having a composite structure, the problem of insufficient sound pressure may still exist, and also due to the low flexibility thereof, the speaker in the present disclosure cannot be broadly applied to different electronic products.

A piezoelectric structure is disclosed in U.S. Pat. No. 7,166,952. FIG. 4(*a*) is a top view of a piezoelectric structure 400, and FIG. 4(*b*) is a cross-sectional view of the piezoelectric structure 400. Referring to FIG. 4(*a*) and FIG. 4(*b*), in the present disclosure, positive/negative electrodes of a piezoelectric material are fixed to the folds 410 of a plastic material to increase the amplitude. According to the present disclosure, the amplitude is increased because of the effect of the upper separated electrodes 412 and the lower continuous electrodes 414 on the folds 410. However, the piezoelectric structure in the present disclosure requires very complicated process and high cost, and insufficient sound pressure may be caused by driving the diaphragm having the folded structure with a piezoelectric bar.

SUMMARY OF THE INVENTION

One of the disclosed embodiments includes a micro-speaker having a sandwich structure. The sandwich structure includes a first ring-shaped piezoelectric material, a second ring-shaped piezoelectric material, and a diaphragm, wherein the diaphragm is between the first ring-shaped piezoelectric material and the second ring-shaped piezoelectric material.

Another of the disclosed embodiments may include a micro-speaker including a first piezoelectric material layer, a second piezoelectric material layer, and a diaphragm, wherein the diaphragm is between the first piezoelectric material layer and the second piezoelectric material layer. A peripheral area of the diaphragm is held by the first piezoelectric material layer and the second piezoelectric material layer, and a central area of the diaphragm is served as a vibrating area of the micro-speaker for producing sound.

Another of the disclosed embodiments may include a manufacturing method of a micro-speaker. The manufacturing method includes following steps. First, a piezoelectric material is provided, and two piezoelectric material layers having metal electrodes on the surfaces thereof are formed. The two piezoelectric material layers are cut to form a first piezoelectric material layer with a hollow area and a second piezoelectric material layer with a hollow area. The first piezoelectric material layer, a diaphragm, and the second piezoelectric material layer are combined to form a sandwich structure, wherein the diaphragm is between the first piezoelectric material layer and the second piezoelectric material layer, a peripheral area of the diaphragm is held by the first piezoelectric material layer and the second piezoelectric material layer, and a central area of the diaphragm is served as a vibrating area of the micro-speaker for producing sound through the hollow areas of the first piezoelectric material layer and the second piezoelectric material layer.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 2(*b*) is a top view of the bimorph disk-type piezoelectric loudspeaker in FIG. 2(*a*).

FIG. 3(*b*) is a cross-sectional view of an upgraded conventional piezoelectric speaker.

FIG. 3(*c*) illustrates frequency response curves of the piezoelectric speaker in FIG. 3(*a*) and the upgraded piezoelectric speaker in FIG. 3(*b*).

FIG. 4(*b*) is a cross-sectional view of the corrugated-type piezoelectric structure in FIG. 4(*a*).

FIG. 5(*b*) is a cross-sectional view of a micro-speaker according to an embodiment of the present invention.

DESCRIPTION OF THE EMBODIMENTS

Figure 1A:
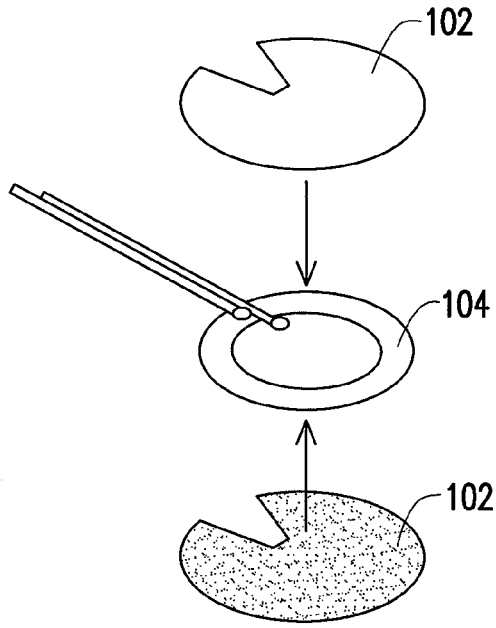
FIG.1(a) (PRIOR ART)
FIGS. 1(*a*)~1(*c*) are diagram illustrating the structure and laminated package of a conventional laminated piezoelectric transducer.
Figure 1B:
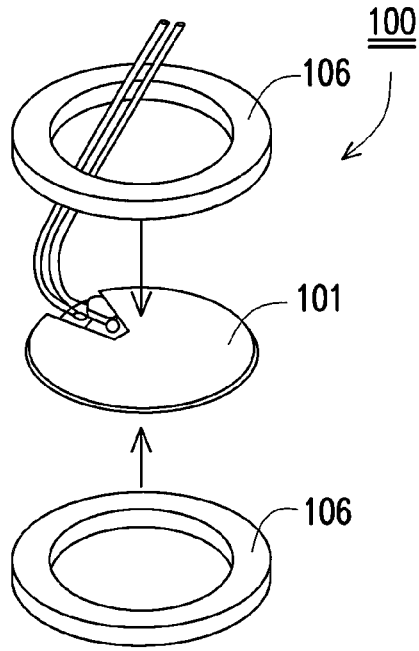
FIG.1(b) (PRIOR ART)
Figure 1C:
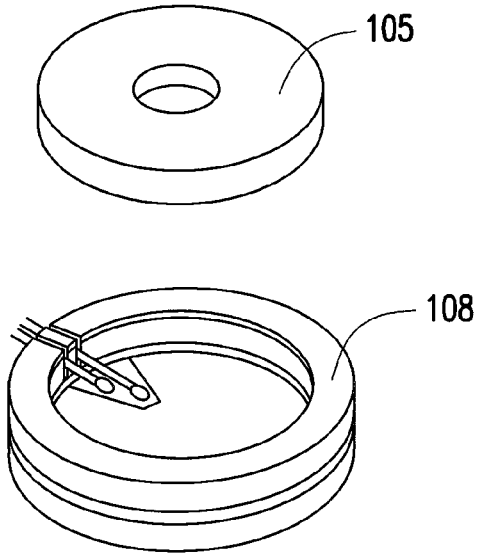
FIG.1(c) (PRIOR ART)
Figure 2A:
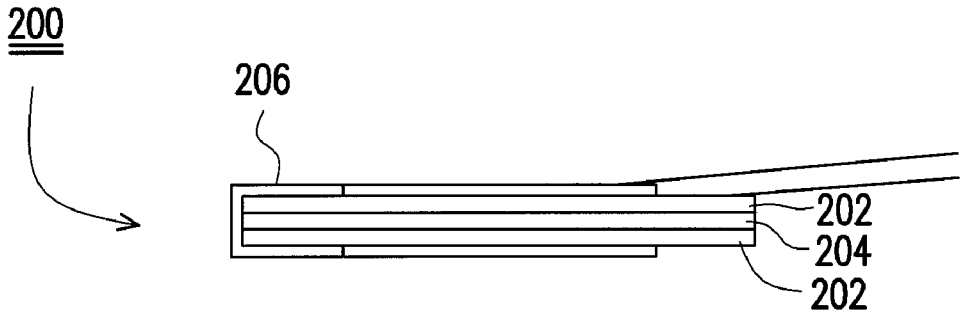
FIG.2(a) (PRIOR ART)
FIG. 2(*a*) is a cross-sectional view of a bimorph disk-type piezoelectric loudspeaker.
Figure 2B:
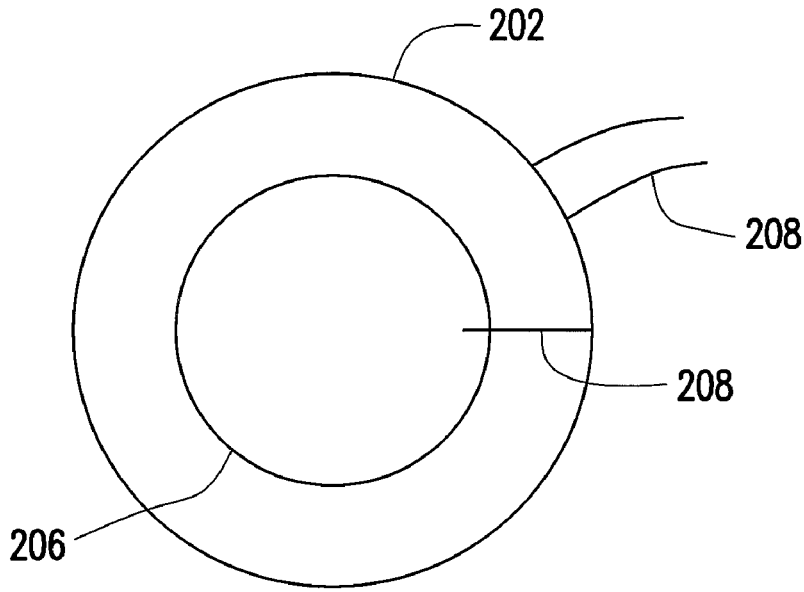
FIG.2(b) (PRIOR ART)
Figure 3A:
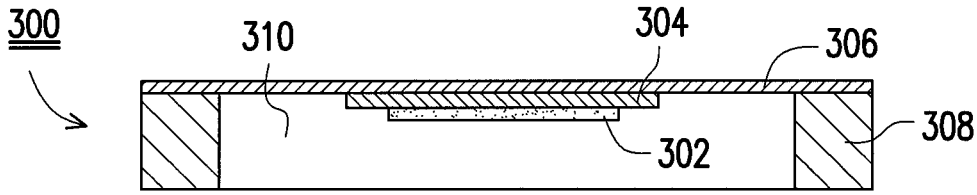
FIG.3(a) (PRIOR ART)
FIG. 3(*a*) is a cross-sectional view of a conventional piezoelectric speaker.
Figure 3B:
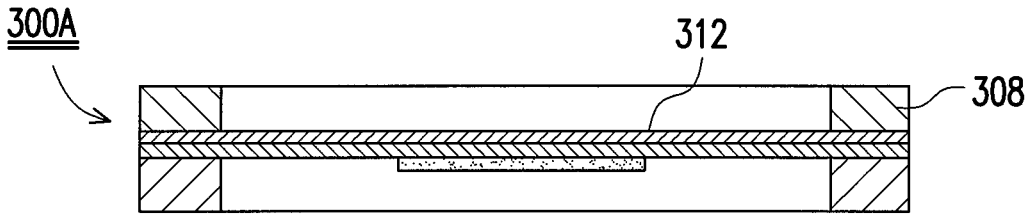
FIG.3(b) (PRIOR ART)
Figure 3C:
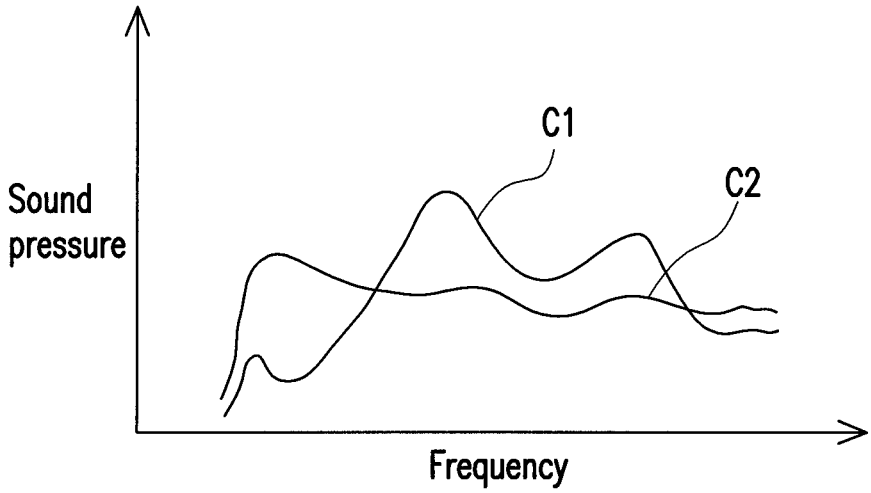
FIG.3(c) (PRIOR ART)
Figure 4A:
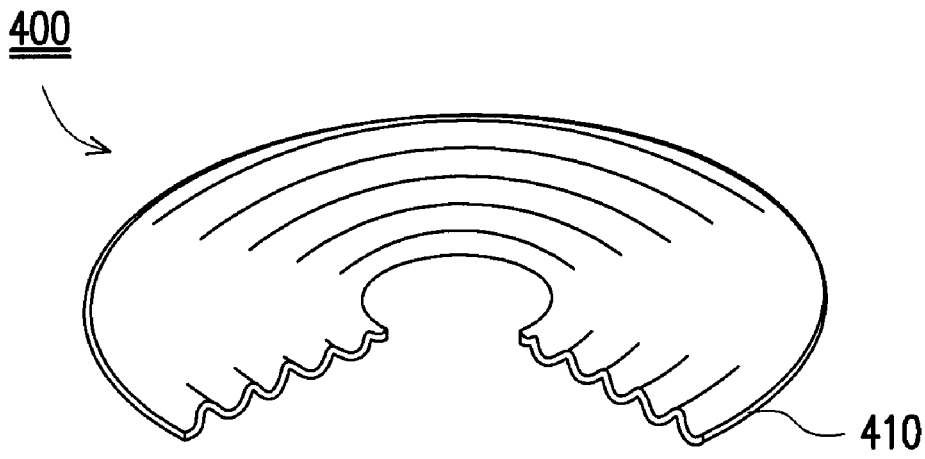
FIG. 4(*a*) is a top view of a corrugated-type piezoelectric structure.
Figure 4B:
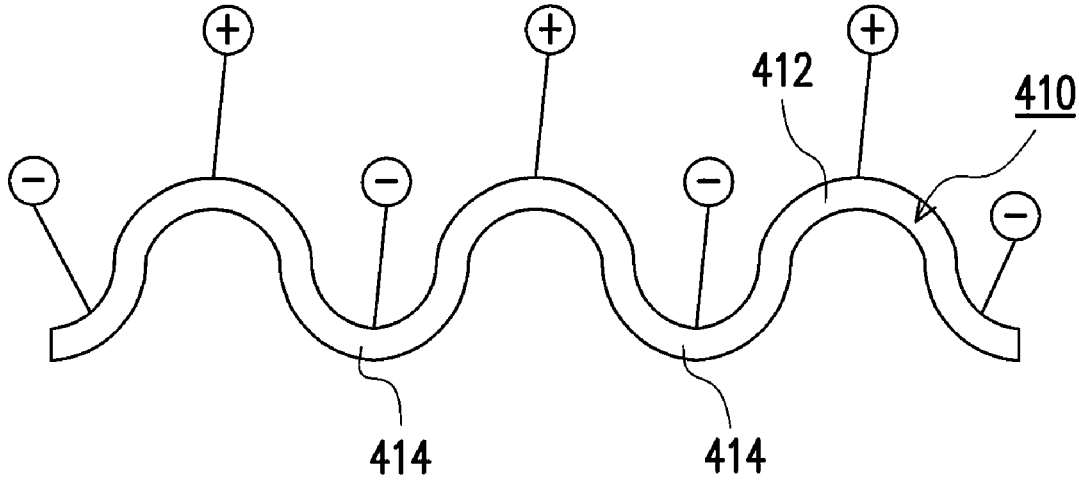

Reference will now be made in detail to the present preferred embodiments of the invention, examples of which are illustrated in the accompanying drawings. Wherever possible, the same reference numbers are used in the drawings and the description to refer to the same or like parts.

One of the disclosed embodiments includes a micro-speaker and a manufacturing method thereof. The problem of insufficient sound pressure at low frequency in conventional micro-speaker is avoided. The flexibility and the endurance of bending of the micro-speaker can also be improved.

According to an embodiment include a micro-speaker having a sandwich structure is provided, where the sandwich structure includes two piezoelectric material layers and a diaphragm disposed between the two piezoelectric material layers.

The embodiment provides a micro-speaker having a sandwich structure, and a piezoelectric material layer of the micro-speaker may be a flexible piezoelectric diaphragm. The flexible piezoelectric diaphragm may be made of polyvinylidene difluoride (PVDF), composite PZT, or a combination of PVDF and composite PZT. In an embodiment of the present invention, the piezoelectric material layer of the micro-speaker may have a ring shape or other shapes with a hollow area.

Consistent with the disclosed embodiments, the diaphragm of the micro-speaker may be a flexible diaphragm, where the flexible diaphragm may be made of a polymer thin film material, such as polydimethylsiloxane (PDMS). While in another embodiment of the present invention, the diaphragm may also be a rigid diaphragm.

Another of the disclosed embodiments provides a manufacturing method of a micro-speaker. The manufacturing method includes following steps. A layer of metal electrodes are coated on an upper surface and a lower surface of the soft piezoelectric material. Then, a hole is cut in the soft piezoelectric material by using a hole cutter, so as to form a ring-shaped soft piezoelectric material structure. In addition, a layer of mold release agent is applied on the surface of a piece of glass, and a polymer thin film material is coated on the layer of mold release agent through spin coating, so as to form a diaphragm. After that, the surface of the ring-shaped soft piezoelectric material structure is adhered to the surface of the diaphragm, and the two are bonded together to form a ring-shaped piezoelectric material structure having a diaphragm. Two sets of such ring-shaped soft piezoelectric material structures with diaphragm are adhered together to form the micro-speaker having the sandwich structure.

Accordingly, in a micro-speaker provided by the embodiment, the diaphragm is vibrated by conducting a current through the bimorph ring-shaped piezoelectric material, so that the problems of insufficient sound pressure at low frequency and low flexibility in the conventional piezoelectric micro-speaker can be avoided. In the embodiment, two ring-shaped piezoelectric materials are served as an upper and a lower vibration exciter, and electrodes are coated over an upper and a lower surface of a flexible diaphragm. After that, the flexible diaphragm is placed between the two ring-shaped piezoelectric materials as a diaphragm. As a result, an excellent sound-frequency curve can be obtained.

Figure 5A:
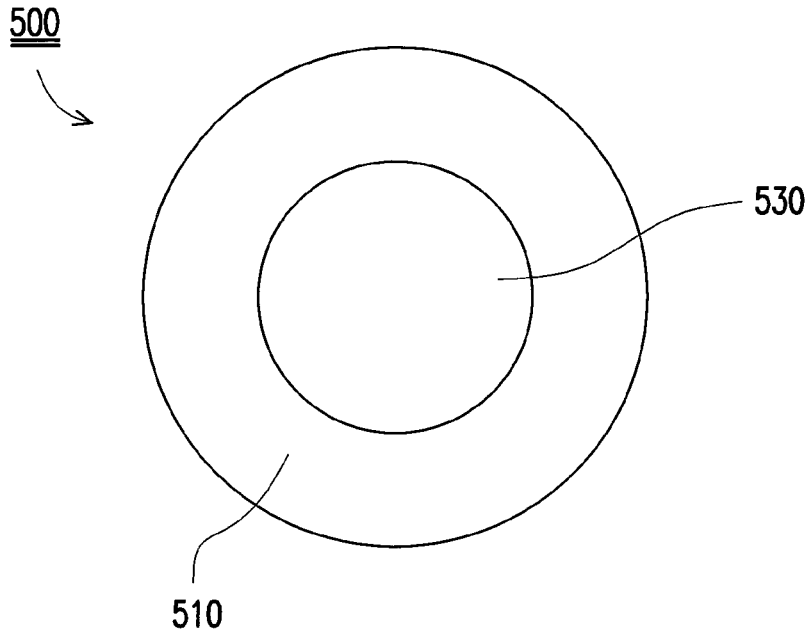
FIG. 5(*a*) is a top view of a micro-speaker according to an embodiment of the present invention.
Figure 5B:
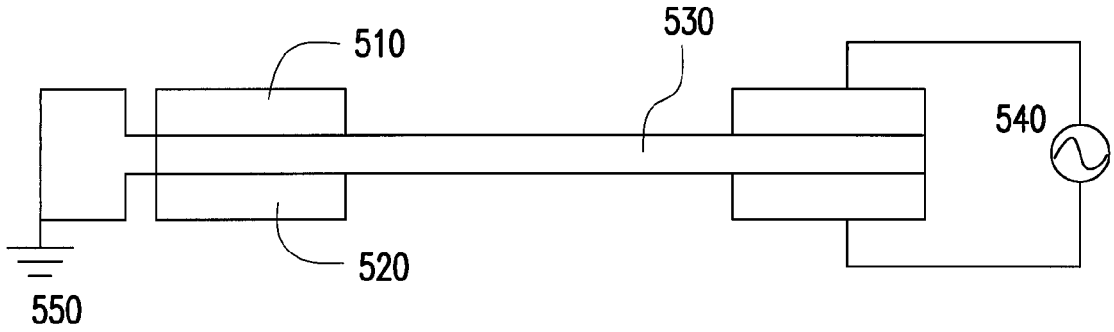

FIG. 5(*a*) and FIG. 5(*b*) are respectively a top view and a cross-sectional view of an embodiment of a micro-speaker. In the embodiment, the micro-speaker 500 includes two ring-shaped piezoelectric material layers 510 and 520, a diaphragm 530, an input electrode 540, and a ground electrode 550. The diaphragm 530 is located between the ring-shaped piezoelectric material layers 510 and 520 and held by the two. The ring-shaped piezoelectric material layer 510, the diaphragm 530, and the ring-shaped piezoelectric material layer 520 are stacked together to form a sandwich structure. A ring-shaped peripheral area 534 of the diaphragm 530 is held by the ring-shaped piezoelectric material layers 510 and 520, and a central area 532 thereof is served as a vibrating area of the micro-speaker 500 for producing sound.

The input electrode 540 is connected to an end surface of the ring-shaped piezoelectric material layers 510 and 520, and the ground electrode 550 is connected to the other end surface of the ring-shaped piezoelectric material layers 510 and 520. Such a disposition allows the vibration of the diaphragm 530 to be transmitted inwards so that the vibration amplitude can be increased and the problem of insufficient sound pressure can be resolved.

The ring-shaped piezoelectric material layer 510 includes a flexible piezoelectric diaphragm, such as PVDF. In another embodiment, the ring-shaped piezoelectric material layer 510 may be formed of composite PZT. The composite PZT not only has many advantages (for example, high heat-resistance, high erosion-resistance, and high efflorescence-resistance, etc) of conventional ceramic material, but also has advantages in electricity, magnetism, sound, light, or other aspects, therefore can be applied to micro-speakers.

The diaphragm 530 may be a flexible diaphragm, and which may be made of a polymer thin film material. In an embodiment, the diaphragm 530 may be made of PDMS, wherein PDMS is a flexible polymer material which can increase biological compatibility, such that the micro-speaker can be applied in the biomedical engineering industry.

In another embodiment, the diaphragm 530 may also be a rigid diaphragm. By adopting a rigid diaphragm, the sound quality is improved in the high frequency rang but the flexibility of the speaker is reduced. However, the material of the diaphragm is not limited in the present invention.

The input electrode 540 is located on the upper surface of the upper ring-shaped piezoelectric material layer and the lower surface of the lower ring-shaped piezoelectric material layer, and an alternating current (AC) voltage is input into the input electrode 540. Thus, the vibration amplitude can be increased by connecting the upper and the lower layer to synchronous voltages. Moreover, because the flexible diaphragm is made of a soft material, the sound pressure of the speaker at low frequency can be greatly increased.

The ground electrode 550 is located on the contact surface between the upper ring-shaped piezoelectric material layer and the diaphragm 530 and the contact surface between the lower ring-shaped piezoelectric material layer and the diaphragm 530 so that problems caused by instable voltage and static can be avoided.

Figure 6:
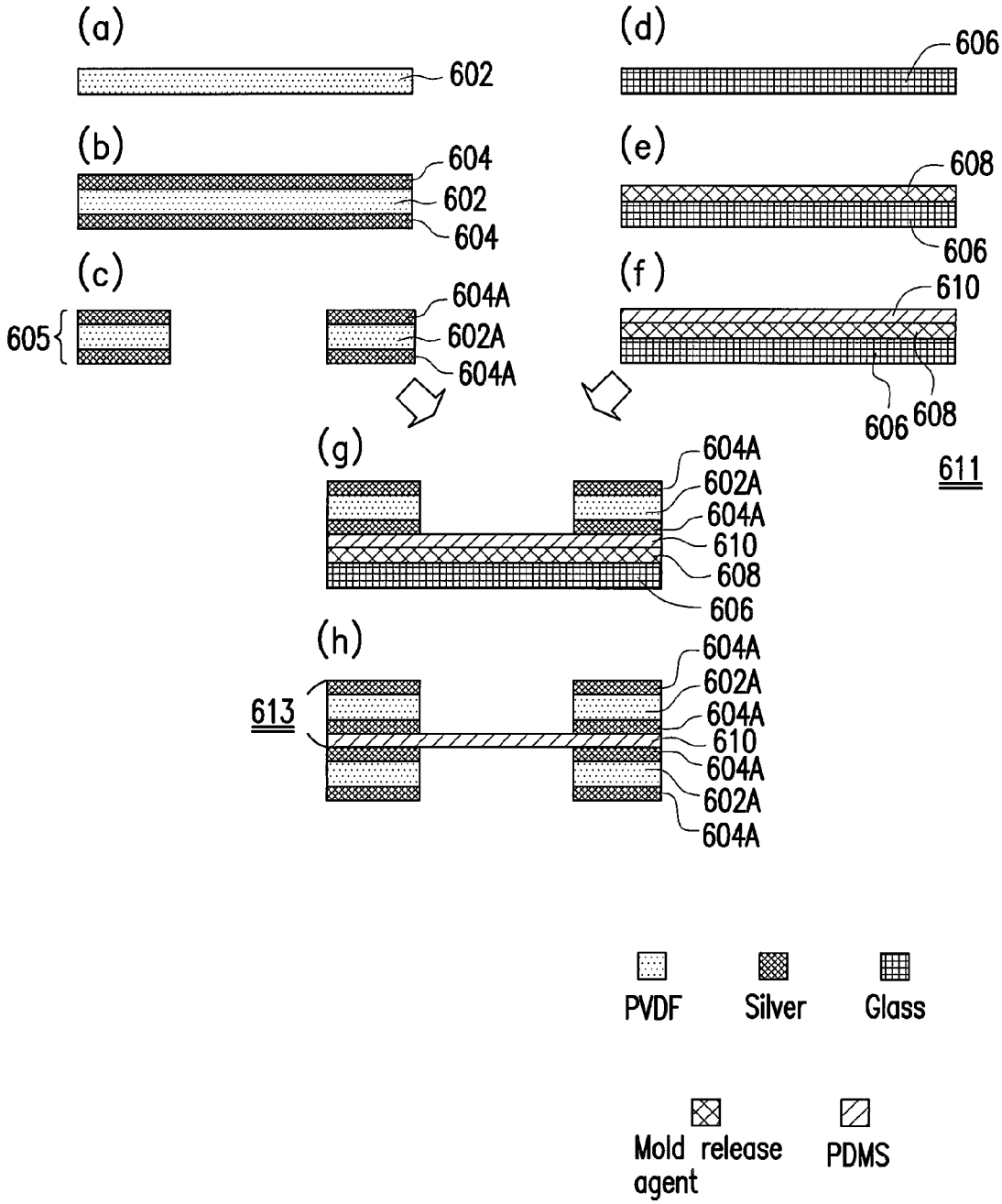
FIG. 6(*a*)~(*h*) are cross-sectional views illustrating a manufacturing method of a micro-speaker according to an embodiment of the present invention.

FIGS. 6(*a*)~(*h*) the detailed process for manufacturing a micro-speaker. Referring to FIGS. 6(*a*)~6(*b*), first, a soft piezoelectric material (for example, PVDF, and the thickness thereof is 110 μm) is provided to form a PVDF film 602, and a layer of silver electrodes 604 are coated over the upper and lower surface of the PVDF film 602. In the present embodiment, the electrodes are made of silver; however, the embodiment is not limited thereto.

As shown in FIG. 6(*c*), a hole is cut in the PVDF film 602 by using a hole cutter, so as to form a ring-shaped PVDF structure 605. The upper and lower layer of the ring-shaped PVDF structure 605 has silver electrodes 604A, and the middle layer thereof is a PVDF film 602A. As a result, a ring-shaped hollow sandwich structure is formed.

As shown in FIGS. 6(*d*)~6(*e*), a layer of mold release agent 608 is coated over the surface of a piece of glass 606.

As shown in FIG. 6(*f*), a layer of polymer thin film, material (for example, PDMS) is coated over the layer of mold release agent 608 through spin coating to form a PDMS composite structure 611. The thickness of the PDMS film 610 is 50 μm, and the PDMS film 610 is served as a diaphragm.

As shown in FIG. 6(*g*), the ring-shaped PVDF structure 605 is adhered to the PDMS composite structure 611, and the two are bonded together in a vacuum oven. Because being coated with the mold release agent in advance, the glass 606 can be easily separated with the PDMS diaphragm 610 to form a ring-shaped PVDF structure 613 having a PDMS film.

Finally, the steps illustrated in FIGS. 6(*a*)~6(*g*) are repeated to form a speaker structure having bimorph ring-shaped PVDF structures and a PDMS film between the bimorph ring-shaped PVDF structures. After adhering foregoing three parts, a micro-speaker provided by the embodiment is completed, and the micro-speaker has a ring-shaped hollow structure. If the micro-speaker is made of a polymer material, the micro-speaker is then a flexible micro-speaker.

Figure 7:
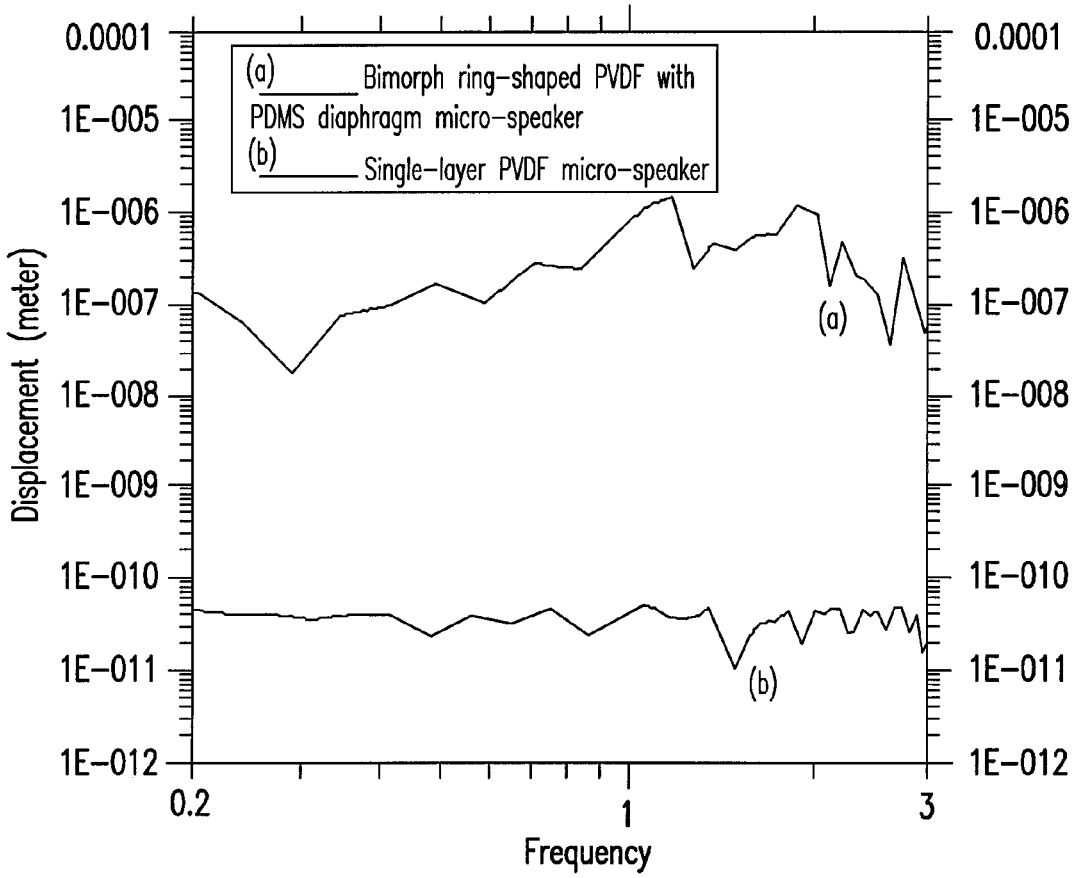
FIG. 7 is a diagram comparing the sound pressures of a conventional single-disc piezoelectric vibration exciter and a bimorph ring-shaped piezoelectric material in an embodiment of the present invention.

FIG. 7 is a diagram comparing the sound pressures of a conventional single-layer piezoelectric vibration exciter and a bimorph ring-shaped piezoelectric material in the embodiment. Referring to FIG. 7, the abscissa indicates frequency, and the ordinate indicates displacement. This is to compare the conventional single-layer purpose of piezoelectric vibration exciter and the bimorph ring-shaped piezoelectric vibration exciter in the present embodiment. Herein the vibration excited diaphragm is made of PVDF, and the frequency thereof falls between 0.2 kHz and 3 kHz, and the driving electrode thereof is 10 Vpp.

As shown in FIG. 7, the upper curve (a) shows the relationship between the frequency of the bimorph ring-shaped piezoelectric vibration exciter and the displacement of the corresponding diaphragm. The lower curve (b) shows the relationship between the frequency of the single-layer piezoelectric vibration exciter and the displacement of the corresponding diaphragm. The displacement produced by the single-layer piezoelectric vibration exciter is about $10^{-10}$ meters. However, the displacement produced by the bimorph ring-shaped piezoelectric vibration exciter can be increased to the level of $10^{-7}$ meters. Obviously, by adopting the bimorph ring-shaped structure, the problem of insufficient sound pressure at low frequency produced by the conventional piezoelectric material can be resolved, and besides, the problem of insufficient sound pressure caused by the stiffer structure of single-layer vibration exciter instead of soft diaphragm in the present embodiment.

Figure 8:
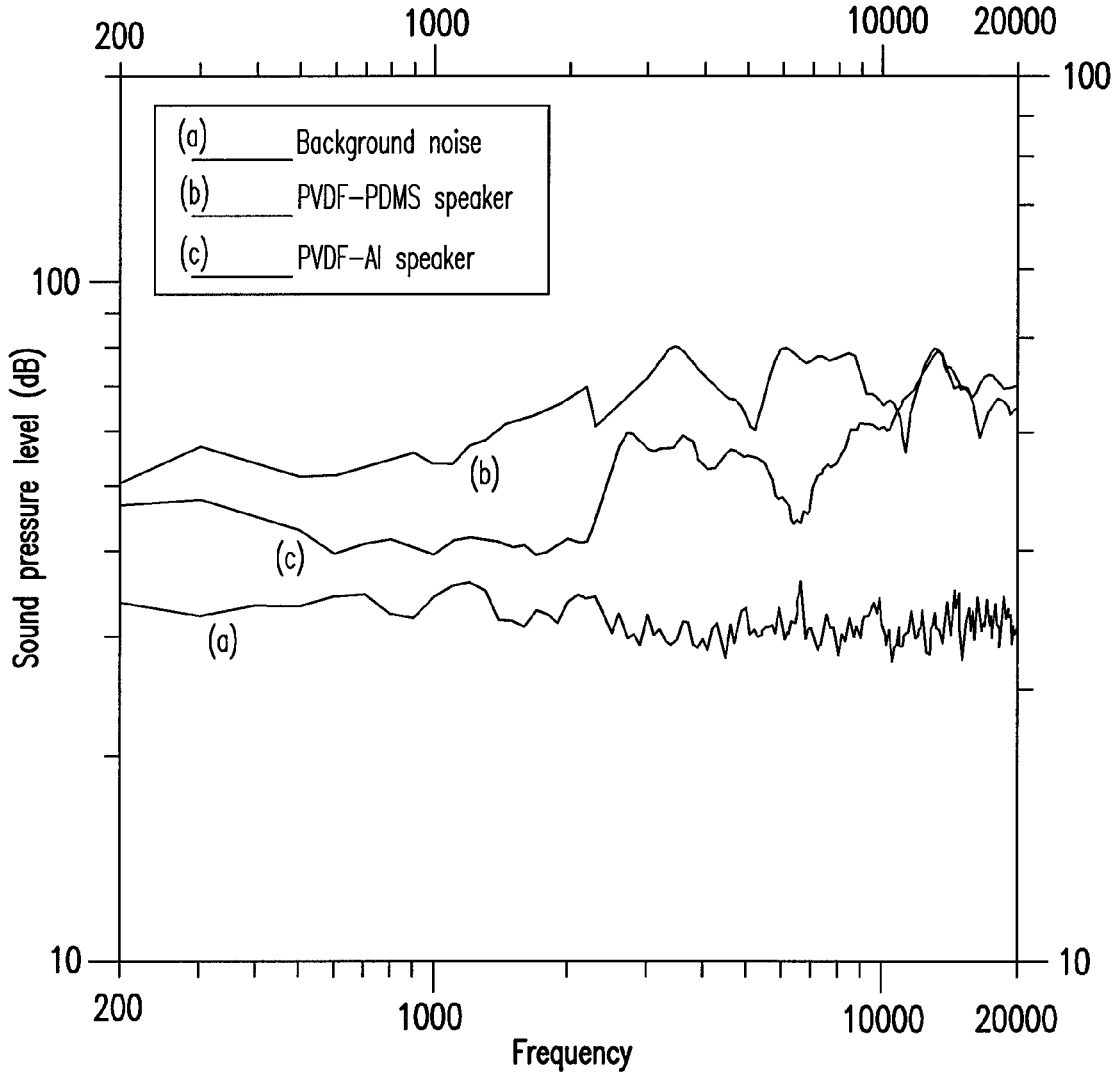
FIG. 8 illustrates frequency response curves of a bimorph ring-shape piezoelectric speaker with Aluminum diaphragm and PDMS diaphragm, respectively.

FIG. 8 illustrates the frequency response curves of a bimorph ring-shape piezoelectric speaker with Aluminum diaphragm (PVDF-Al speaker) and a bimorph ring-shape piezoelectric speaker with PDMS diaphragm (PVDF-PDMS speaker). Referring to FIG. 8, the abscissa indicates the audible frequency range to the human ear, and the ordinate indicates the sound pressure level (dB). There are three curves (a), (b), and (c) in FIG. 8, and these three curves respectively represent the frequency response of the background noise, the PVDF-PDMS speaker, and the PVDF-Al speaker. Both the sound pressure values of the PVDF-PDMS speaker and the PVDF-Al speaker exceed that of the background noise so that they can produce sound. As shown in FIG. 8, the sound pressure value of the PVDF-PDMS speaker at 200 Hz is about 60 dB, which is higher than that of the PVDF-Al speaker. Obviously, the frequency response curve of the PVDF-PDMS speaker has better performance than that of the PVDF-Al speaker.

As described above, in the embodiment, a bimorph ring-shaped piezoelectric material is adopted, and a polymer thin film material is held by the bimorph ring-shaped piezoelectric material to form a sandwich structure. The bimorph ring-shaped piezoelectric material is served as the vibration source, while a diaphragm made of a polymer material is served as a diaphragm for producing sound.

The method for driving the upper and lower ring-shaped piezoelectric material can resolve the problem of insufficient sound pressure caused by the single-layer vibration source. Because the diaphragm is made of a soft material and synchronous voltages are respectively supplied to the upper and lower ring-shaped piezoelectric material, the vibration amplitude of the diaphragm can be increased. Accordingly, the sound pressure at low frequency can be greatly increased and the low-frequency response of the micro-speaker can be improved. In addition, the present invention provides a simple manufacturing method so that the cost of the micro-speaker is kept low.

In particular, a flexible manufacturing technique may also be applied to the micro-speaker in the embodiment. Because the product manufactured through this technique has such advantages as light weight, low cost, and high surge-resistance, the product can be broadly applied and offer more room in product design and convenience to the users. The flexibility of the micro-speaker in the present embodiment allows the micro-speaker to be bended appropriately according to the space so that components in the micro-speaker can be disposed more space-efficiently and accordingly the product can be minimized in its volume. In the future, the micro-speaker in the present invention may be applied to electronic paper to allow the electronic paper to give out sound and accordingly bring more lively information to the users. The flexible micro-speaker may even be applied to electronic clothing. In this case, besides being used for playing music, the micro-speaker may also be used for notifying the user of biological signals captured by sensors on the electronic clothing through music. Moreover, the flexible micro-speaker in the embodiment can be integrated with electronic clothing to provide alarm sound or district description for those visually handicapped users. Furthermore, a wearable cell phone may be made more attractive to the user if the flexible micro-speaker in the embodiment is disposed therein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A micro-speaker, comprising:

a first piezoelectric material layer and a second piezoelectric material layer; and a diaphragm, disposed between the first piezoelectric material layer and the second piezoelectric material layer, wherein a peripheral area of the diaphragm is held by the first piezoelectric material layer and the second piezoelectric material layer, and a central area of the diaphragm is served as a vibrating area of the micro-speaker for producing sound, wherein the first piezoelectric material layer and the second piezoelectric material layer have a ring-shaped structure, and the peripheral area of the diaphragm is held by the ring-shaped structure.

2. The micro-speaker according to claim 1, wherein the diaphragm comprises a flexible diaphragm.

3. The micro-speaker according to claim 2, wherein the flexible diaphragm is made of a polymer thin film material.

4. The micro-speaker according to claim 1, wherein the diaphragm is a rigid diaphragm.

5. The micro-speaker according to claim 1, wherein the first piezoelectric material layer and the second piezoelectric material layer form a bimorph ring-shaped structure, and a substantial peripheral area of the diaphragm is held by the bimorph ring-shaped structure.

6. The micro-speaker according to claim 1, wherein the first piezoelectric material layer and the second piezoelectric material layer are flexible piezoelectric material layers.

7. The micro-speaker according to claim 6, wherein the flexible piezoelectric material layers are made of polyvinylidene pifluoride (PVDF), composite PZT, or a combination of PVDF and composite PZT.

8. The micro-speaker according to claim 1 further comprising a first input electrode and a second input electrode, wherein the first input electrode is connected to the first piezoelectric material layer and the second input electrode is connected to the second piezoelectric material layer for supplying an operation power to the micro-speaker.

9. A manufacturing method of a micro-speaker, comprising:

forming two piezoelectric material layers by piezoelectric materials;

forming with metal electrodes at both sides of each of the piezoelectric material layers;

cutting the two piezoelectric material layers to form a first piezoelectric material layer with a hollow area and a second piezoelectric material layer with a hollow area;

forming a diaphragm; and combining the first piezoelectric material layer, the diaphragm, and the second piezoelectric material layer to form a sandwich structure, wherein the diaphragm is disposed between the first piezoelectric material layer and the second piezoelectric material layer, a peripheral area of the diaphragm is held by the first piezoelectric material layer and the second piezoelectric material layer, and a central area of the diaphragm is exposed through the hollow areas and the central area served as a working area of the micro-speaker for producing sound through the hollow areas of the first piezoelectric material layer and the second piezoelectric material layer.

10. The manufacturing method according to claim 9, wherein the step of forming the piezoelectric material layer with the metal electrodes comprises:

forming a metal electrode layer on a first surface and a second surface of each of the piezoelectric material layers, wherein the first surface and the second surface are respectively both sides of the piezoelectric material layer; and cutting the piezoelectric material layer having the metal electrode layer to form a structure having the hollow area in the middle, namely, the piezoelectric material layer with the metal electrodes.

11. The manufacturing method according to claim 10, wherein the step of cutting the piezoelectric material layer having the metal electrode layer is to cut the circular hollow area by using a hole cutter.

12. The manufacturing method according to claim 10, wherein the metal electrode layer comprises silver.

13. The manufacturing method according to claim 10, wherein the piezoelectric material layer is made of a soft piezoelectric material.

14. The manufacturing method according to claim 13, wherein the soft piezoelectric material comprises PVDF.

15. The manufacturing method according to claim 9, wherein the step of forming the diaphragm comprises:

applying a layer of mold release agent on a surface of a piece of glass; and spin coating a polymer thin film material layer on the layer of mold release agent to form the diaphragm.

16. The manufacturing method according to claim 15, wherein the polymer thin film material layer comprises polydimethylsiloxane (PDMS).

17. The manufacturing method according to claim 9, wherein the step of combining the first piezoelectric material layer, the diaphragm, and the second piezoelectric material layer comprises:

adhering the first piezoelectric material layer and the second piezoelectric material layer on a surface of the diaphragm; and forming the sandwich structure through pressurizing and heating.

* * * * *